US006178675B1

(12) United States Patent
Strother

(10) Patent No.: US 6,178,675 B1
(45) Date of Patent: Jan. 30, 2001

(54) DISPLAY DEVICE FOR IMAGES

(76) Inventor: Louis L. Strother, 163 Village La., Gray, TN (US) 37615

( * ) Notice: Under 35 U.S.C. 154(b), the term of this patent shall be extended for 0 days.

(21) Appl. No.: 09/411,927

(22) Filed: Oct. 4, 1999

(51) Int. Cl.[7] ..... G09F 11/02
(52) U.S. Cl. ..... 40/503
(58) Field of Search ..... 40/503, 506, 493

(56) References Cited

U.S. PATENT DOCUMENTS 2,978,821 * 4/1961 Kaufmann, Jr. ..... 40/505
3,383,785 * 5/1968 Werner ..... 40/505
4,189,859 * 2/1980 Ahlgren ..... 40/505
4,381,616 * 5/1983 Saxer ..... 40/503
5,297,353 * 3/1994 Ghalayini ..... 40/503
5,487,203 * 1/1996 Brach, Jr. et al. ..... 40/586

* cited by examiner

*Primary Examiner*—Cassandra H. Davis

(57) ABSTRACT

A pictorial image viewing device for use on a desk top, shelf or the like in home or office, wherein a plurality of triangular image holders are pivotally mounted on a support, wherein the holders are unobstructed at their tops for easy entry onto and removal of various images from the holders, and wherein transmission structure is provided for synchronously pivoting the holders to selectively present different images to a viewing front or plane.

12 Claims, 3 Drawing Sheets

DISPLAY DEVICE FOR IMAGES

BACKGROUND OF THE INVENTION

1. Field

This invention concerns a display device for selectively presenting multiple series of images such as photographs, pictures, writings, or other, hereinafter all termed "image(s)", for viewing, particularly as a scene, along a planar or curved viewing front. The principal use of the invention is in displaying such images, particularly those having a personal or family connection, in a home, office or the like.

2. Prior Art

Prior devices have been proposed for presenting the viewing faces of prismatic sign supports or the like for visual viewing, however, such devices are large, complicated in construction and are not suited for desk top, or the like, use where easy and quick changing of the scene images is desirable. For example, U.S. Pat. Nos.: 3,921,321; 5,692,330; 5,528,258; 5,297;353; 4,638,580; and 3,983,648 show such prior devices, the disclosures of which, particularly with respect to the image holder pivoting mechanisms thereof, are hereby incorporated herein by reference.

Principal objects therefore of the invention are: to provide an easy to use and simply constructed device of, for example, a length of about 6 to 12 inches, for displaying a scene or panorama of any number of pictorial or other images, particularly of a personal or family nature, wherein the display comprises separate images constituting the scene, and wherein a simple hand manipulation can change the scene to an entirely different one in a fraction of a second, and wherein the device is desk top handy; and to provide such device with structure which allows easy and quick change of images which make up the scene.

SUMMARY OF THE INVENTION

The above the other objects hereinafter appearing have been attained thru the discovery of an image scene display device which features a plurality of synchronously pivotal, in-line, unobstructed top, tandem pivotal image holders or armatures which provide easy access for changing images.

BRIEF DESCRIPTION OF THE DRAWINGS

The invention will be further understood from the drawings and description of preferred embodiments of the invention, wherein the figures are not to scale and certain dimensions are exaggerated for purposes of clarity. In the drawings.

DETAILED DESCRIPTION

Figure 1:
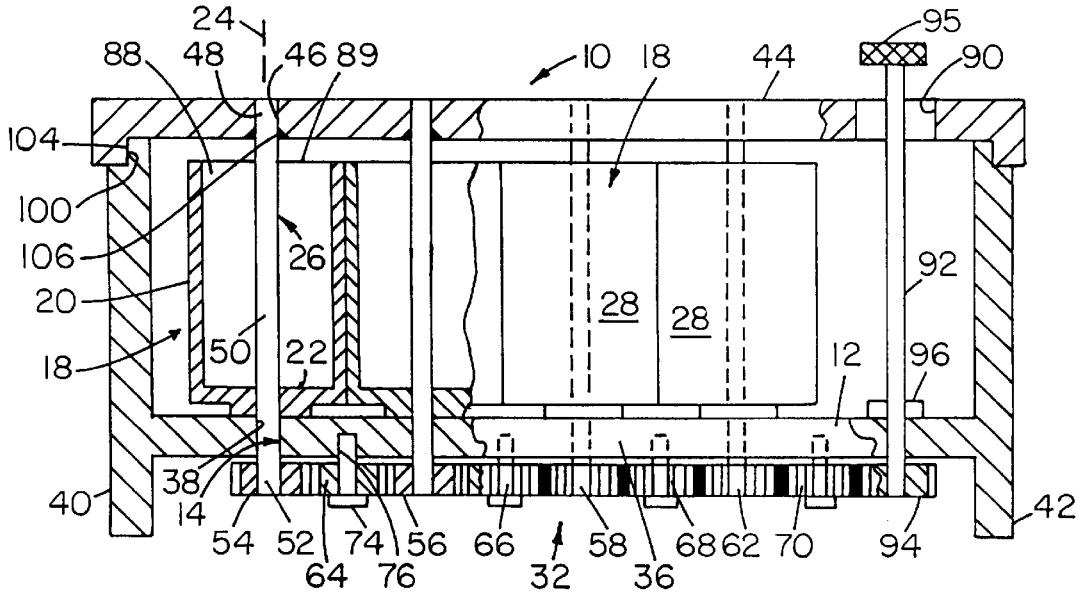
FIG. 1 is a front view of the present device with portions of viewing faces and support portions broken away to the mounting shafts thereof for clarity.

Referring to the drawings and with particular reference to the claims hereof, the present device 10 comprises an elongated support means 12, preferably of a length of from about six to about twelve inches for easily resting on a desk top, but which can be of any size depending on the image size. Means 12 has a plurality of first pivot means of bearings 14 arranged along a mounting axis 16 of said support means. A like plurality of any number of armature means 18 are provided, each having an elongated body portion 20, base means 22, a longitudinal axis 24, and a second pivot means or shaft 26 pivotally associated with a said first pivot means 14 such that all said longitudinal axes 24 are oriented substantially parallel to each other and all of said armature means are pivotal about substantially parallel axes. Each armature means 18 has a plurality of viewing face means, e.g., window means 28 which are comprised of transparent material and are adapted to lie adjacent to or carry a pictorial item or image 30. A power transmission means 32 is provided on some portion of the support means and is associated with each armature means to impart synchronous pivoting of all the armature means about their pivot axes whereby each series of images 30 can be displayed selectively along a viewing front such as 34.

Figure 2:
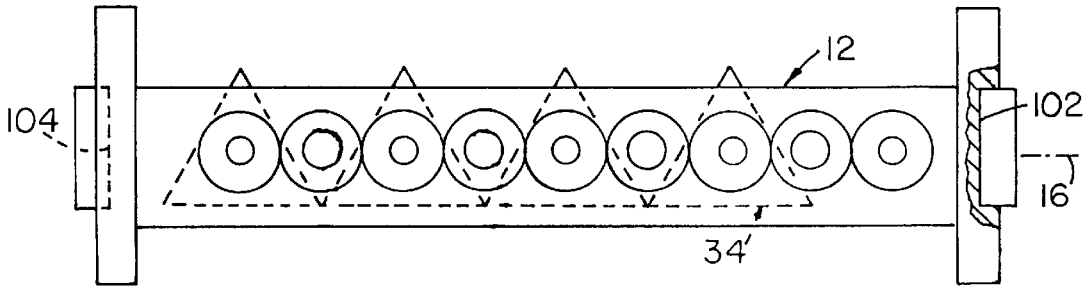
FIG. 2 is a bottom view taken in the direction of line 2—2 in FIG. 1.

In the embodiment shown in FIGS. 1 and 2, the support means 12 is configured to provide an elongated member 36 provided with a plurality of bearing bores 38 on mounting axis 16. Stanchions 40, 42 are provided on the ends of member 36 and support at their tops a stabilizer cap 44 thru which apertures 46 are provided to slidably rotationally receive the upper free ends 48 of shafts 50. These shafts are fixed to the base means 22 of the armatures and are rotatably received in bores 38. In this embodiment, the lower ends 52 of the shafts are fixed to toothed driven gears 54, 56, 58, and 62 which mesh with idler or intermediate gears 64, 66, 68 and 70 respectively. Sufficient clearance is provided between 36 and each base means 22 and the drive gears to allow easy pivoting of the armatures. Likewise, the idler gears are rotatable on their mounting pins 74 which are, e.g., pressed fitted into cavities 76 in member 36. All of these driven and idler gears make up a gear train.

The armatures 18 can be made of glass or any transparent plastic material such as polyolefin, e.g., polyethylene or polypropylene, polystyrene, polyester, or cellulose acetate butyrate. The body portion 20 is of self-supporting thickness, such as, for example, from about 1/10 in., to about 1/8 in., and the base portion 22 preferably is from about 1/8 in., to about 1/4 in., thick. The base and body portions may be molded directly onto the shaft 50 as a monolithic unit. Press-fitting of the base onto the shaft is, of course, an alternative.

Figure 3:
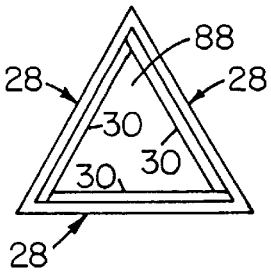
FIG. 3 is an isometric view of a continuous transparent sheet construction for an armature or image holder body portion with three individual images in place therein.
Figure 4:
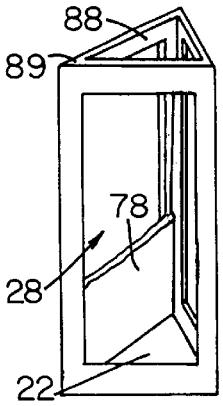
FIG. 4 is an isometric view of a frame-like variation of the armature.
Figure 5:
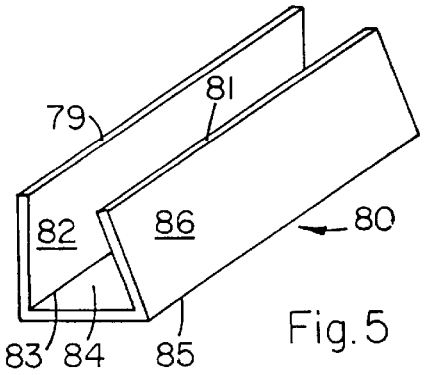
FIG. 5 is an isometric view of a unitary, multi-picture variation of the image.

The armature body portions 20 are preferably of continuous sheet material having a triangular or prismatic cross-section as shown in FIG. 3 but can also be made in transparent picture frame configuration as shown in FIG. 4 wherein a section 78 of an image is shown in viewing position therein. As shown in FIG. 5, a multi-image unit 80 is shown wherein, e.g., sections 82, 84 and 86 of three different scenes are fixed together such that by simply bringing the free edges 79 and 81 toward each other around the joint lines 83 and 85, the unit can be slid down into the armature thru opening 88 in its top 89, and readily withdrawn therefrom to change the scene, i.e., the series of images.

Further regarding the structure of FIGS. 1 and 2, an actuator for the transmission means can comprise any convenient structure, and preferably as shown, cap 44 is provided with an aperture 90 thru which a rotator spindle 92 extends. This shaft is provided with a prime gear 94 which, upon rotation of the spindle by finger knob 95 rotates idler gear 70 and consequently the rest of the gear trains. A collar 96 on the spindle maintains gear 94 in vertical alignment with idler gear 70. The cap 44, in this embodiment can be lifted off of the free ends 48 of shafts 50 to allow the items to be easily slid in or out of the armature thru the top openings 88 thereof. Downturned lips 98 and 100 on the cap ends are dimensioned to slide fit into slots 102 and 104 respectively in the stanchion top to assist in quick alignment of apertures 46 in the cap with the free ends 48 of armature shafts 50. Chamfered edges 106 of apertures 46 further assist in quick alignment by providing a lead-in for the shaft ends.

Figure 11:
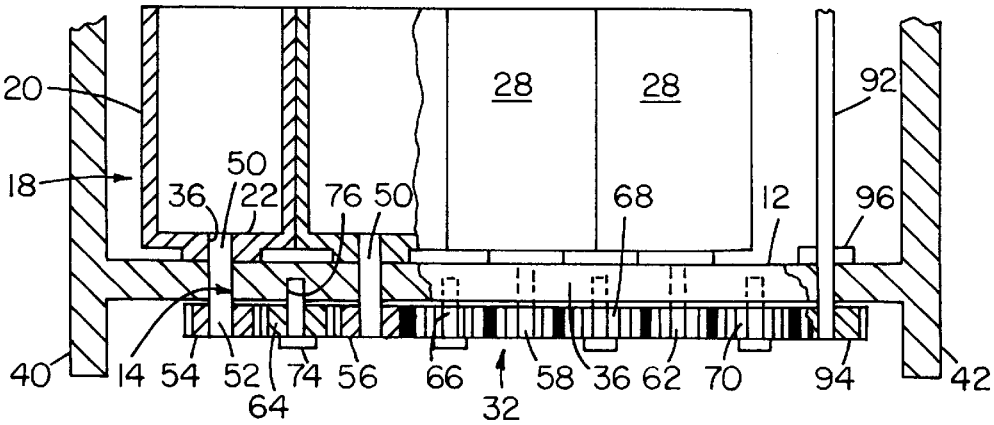
FIG. 11 is a partial view as in FIG. 1 but showing a variation of the device wherein a cap or top is not employed.

As seen from FIG. 11, it is not essential to have a cap to aid in stabilizing the armatures as long as shafts 50, shortened in this embodiment, are mounted in bores 38 with sufficiently close tolerances to prevent wobbling of the armatures and consequent misalignment of the adjacent image edges.

Figure 6:
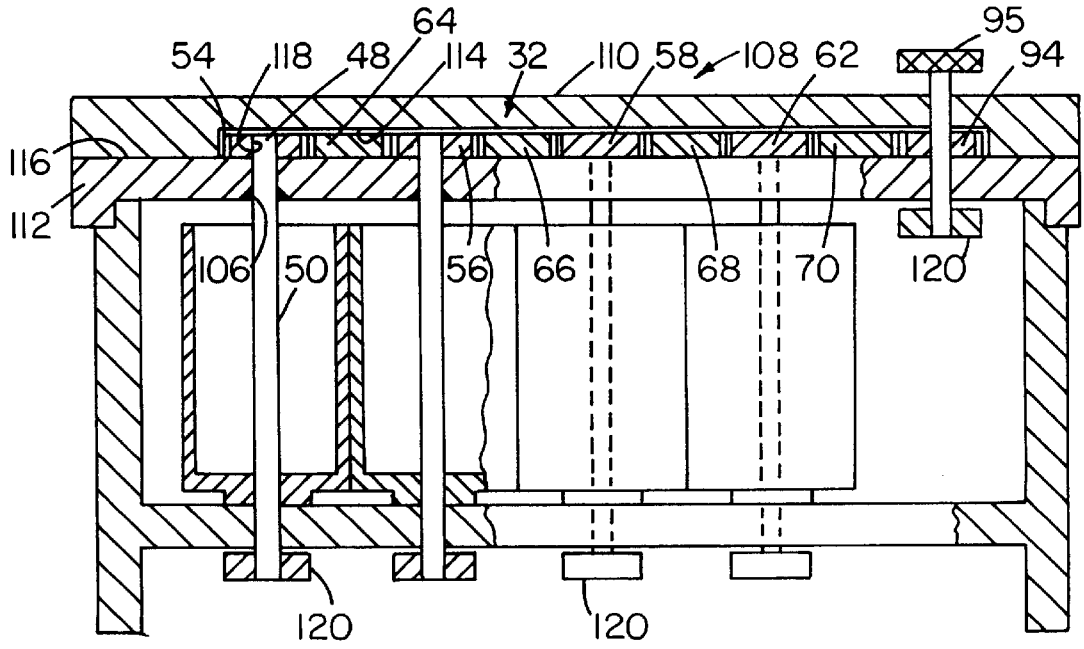
FIG. 6 is a view as in FIG. 1 of a variation in positioning of the armature rotation transmission means in a removable cap means.

Referring to the variation of FIG. 6 wherein structures which are the functional equivalents of those of FIGS. 1 and 2 are numbered the same, the transmission means 32 or gear train of FIG. 1 has been altered to reside in a removable top 108 which may consist of an upper section 110 and a lower section 112. A recess 114 in section 110 and all of the driven and idler gears of the drive train and the prime gear 94 are dimensioned to slidably nestle in said recess with only enough lateral and longitudinal play to allow the gears to properly rotate upon rotation of spindle 92. In this way the construction of the transmission means is greatly simplified. In assembling this embodiment, after the gears have been laid into recess 114, the two section are secured together by any means such as adhesive joint 116. Also in this embodiment the free ends 48 of shafts 50 are splined or cross-sectionally squared or the like such as to lock into cooperating splined or squared apertures 118 in the driven gears and thus be rotated by the gears. As top 108 is lifted off of shaft ends 48, bases 22 of the armatures and collars 120, both fixed to the shafts preventing lifting of the armatures from the support means when changing images.

Figure 7:
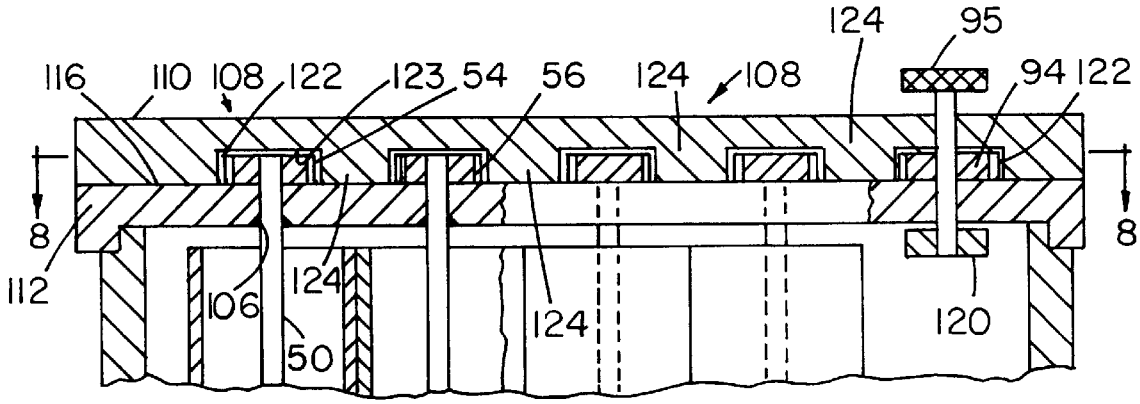
FIG. 7 is a partial view of a variation of the transmission means of FIG. 6 employing a timing belt variation of the drive train.
Figure 8:
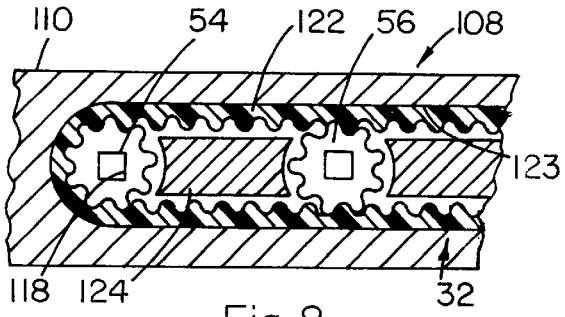
FIG. 8 is a cross-sectional view taken along line 8—8 of FIG. 7.

Referring to FIGS. 7 and 8 another removable top type structure supporting a transmission means is shown, wherein its drive drain is mounted similarly to that of FIGS. 6. This transmission means comprises only the driven gears and prime gear 94, all of which are operably interconnected by a toothed timing belt 122 which is slidably confined within a recess 123 in upper section 110. In this embodiment, guide segments 124 affixed to the top 108 or integrally molded therewith maintain longitudinal positioning of the driven gears.

Figure 9:
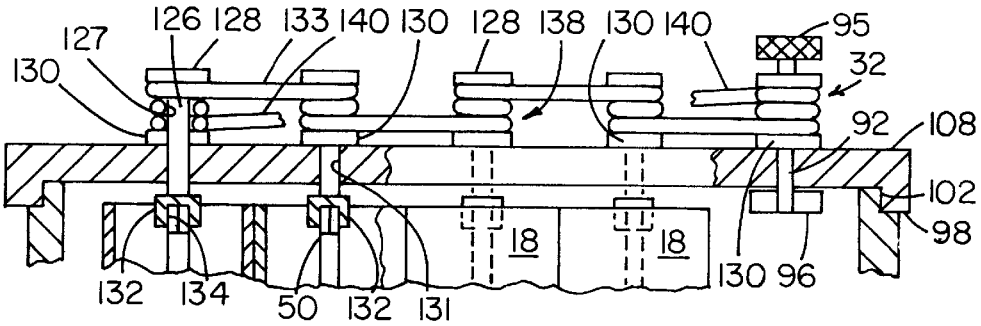
FIG. 9 is a side view of portions of the device as in FIG. 6 with portions broken away for clarity and employing a wrap-around string version of the transmission means and modified armature shaft.
Figure 10:
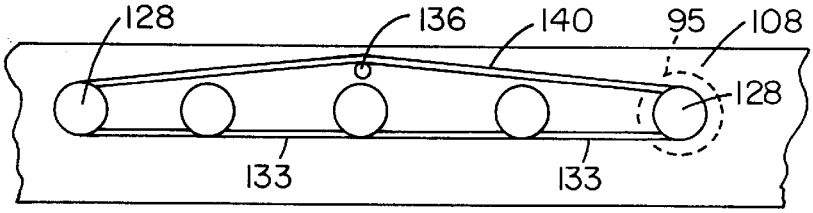
FIG. 10 is a top view taken along line 10—10 of FIG. 9.

Referring to FIGS. 9 and 10, the upper ends of shafts 50 are each modified to comprise, from top down, a mast 126 having spacing collars 128 and 130 affixed thereto to provide a string wrap segment 125 of mast 126. The masts are rotatably mounted in bearing apertures 131 in cap 108 and each has a socket 132 affixed at its lower end. These sockets are formed with a splined or square or the like recess 134 therein for slidably receiving cooperating shaped mating ends of the shaft 50. Again, such construction allows the cap to be removed as necessary to change the images and then easily repositioned with the masts 126 and shafts 150 reconnected for synchronous pivoting of the armatures. Wrap segments 125 may be coated with an elastomeric material 127 such as plasticized PVC or the like to cause the coils of power string 133, cotton or synthetic material, to engage the segment with sufficient friction to prevent their slipping on the mast. A peg 136 or equivalent structure may be employed as a guide to separate the coils 138 of the taut power string from its return strand 140.

Figure 12:
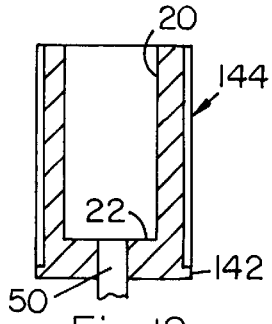
FIG. 12 is a cross-sectional view of a holder taken along line 12—12 of FIG. 2, and shows a variation of the armature structure for allowing mounting of the images on the exteriors of body portions 20.

Referring to FIG. 12, the armature body portion 20 is provided with a thin ledge 142, continuous or in segments, such that a preferred triangular sleeve 144 of images can be readily slid down over the armature to rest on the ledge, and then easily slid upwardly off of the armature for scene changing. The sleeve may be provided by simply connecting edges 79 and 81 of unit 80 of FIG. 5.

This invention have been described in detail with particular reference to preferred embodiments thereof, but it will be understood that variations and modifications will be effected within the spirit and scope of the invention.

I claim:

1. A device for selectively displaying different series of images along a viewing front, said device comprising elongated support means having a plurality of first pivot means arranged along a mounting axis of said support means, a like plurality of armature means each having an elongated body portion which is triangular in cross-section, tubular and open at its top, and is comprised of rigid, transparent material, base means, a longitudinal axis, and a second pivot means pivotally associated with a said first pivot means such that all said longitudinal axes are oriented substantially parallel to each other and all of said armature means are pivotal about substantially parallel axes, each said armature means having a plurality of viewing face means each of which is adapted to carry a said image, and power transmission means on said support means and associated with each said armature means to impart synchronous pivoting of all said armature means about their pivotal axes whereby each said series of images can be displayed selectively along a viewing front.

2. The device of claim 1 wherein said body portion of said armature means is triangular in cross-section and said viewing face means are of sheet construction whereby each said image can be placed plate against the interior or exterior surfaces of a face means.

3. The device of claim 2 wherein a top end of each said armature means is unobstructed whereby said armature means provides a mandrel, and wherein three different images of sheet construction are provided as a continuous triangular sleeve which can be slid down into or over said mandrel into viewing position.

4. The device of claim 1 wherein each said body portion of said armature means is generally of longitudinal tubular configuration and has three substantially rectangular and flat transparent display window means of substantially equal dimensions arranged cross-sectionally in equilateral triangular configuration such that said synchronous pivoting can bring a window means of each armature means into a common viewing front.

5. The device of claim 4 where said transmission means comprises gear means functionally connected to each said shaft means whereby rotation of any of said shaft means will rotate all said shaft means thru the same angle.

6. The device of claim 4 wherein each said armature means comprises a generally tubular shaped body portion of transparent material mounted on a rigid base, and wherein each said second pivot means comprises a shaft segment affixed to said base and extending downwardly thru said first pivot means.

7. The device of claim 4 wherein the spacing of said first pivot means on said support means, and the width of each said window means are selected to allow all said window means to be positioned in close edge-to-edge juxtaposition such that the totality of a scene of images can be readily viewed without significant spatial interruption at the edges of said window means.

8. The device of claim 1 wherein said first pivot means comprises bearing means on said support means, and said second pivot means comprises shaft means on said armature means.

9. The device of claim 8 wherein said transmission means comprises drive belt means frictionally associated with each said shaft means whereby rotation of any of said shaft means will rotate all said shaft means thru the same angle.

10. The device of claim 1 wherein each armature means comprises a generally tubular, triangular cross-section body portion mounted on a rigid base, wherein said viewing faces are the flat sides of the body portion, and wherein three images are provided on a preformed sleeve which is slidably removably mounted on said body portion.

11. The device of claim 1 wherein said support means is comprised of an elongated bottom support, an elongated top support, and stanchion means connected to said supports and maintaining them in spaced, substantially parallel relationship, wherein said first pivot means are provided in said bottom support and wherein a like plurality of third pivot means are provided in said top support, wherein each said second pivot means comprises a shaft fixed to extending upwardly thru said body portion along said longitudinal axis and thru said third pivot means and extending above said top support to provide a string wrap segment of said shaft, wherein said power transmission means comprises a continuous, taut string coiled around each said wrap segment such that rotation of one armature will equally and simultaneously rotate all said armatures, wherein each said wrap segment is removably keyed to its shaft and rotatably mounted on said top support, and wherein said top support is removable from said stanchion means whereby said armature means and images thereon become exposed for easy changing of the images.

12. A device for selectively displaying different series of images along a viewing front, said device comprising elongated support means having a plurality of first pivot means arranged along a mounting axis of said support means, a like plurality of armature means each having an elongated body portion having a generally tubular shaped body portion of transparent material mounted on a rigid base and a second pivot means comprises a shaft segment affixed to said base and extending downwardly thru said first pivot means, and wherein said body portion is open at its top to allow the insertion of images down into or over said body portion and into viewing posture adjacent a window means, base means, a longitudinal axis, and said second pivot means pivotally associated with a said first pivot means such that all said longitudinal axes are oriented substantially parallel to each other and all of said armature means are pivotal about substantially parallel axes, each said armature means having a plurality of viewing face means each of which is adapted to carry a said image, and power transmission means on said support means and associated with each said armature means to impart synchronous pivoting of all said armature means about their pivot axes whereby each said series of images can be displayed selectively along a viewing front.

* * * * *